US011316298B1

(12) United States Patent
Ding et al.

(10) Patent No.: US 11,316,298 B1
(45) Date of Patent: Apr. 26, 2022

(54) SAFETY SOCKET TO PREVENT ELECTRIC SHOCK

(71) Applicant: Dongguan Keben Electrical appliance Co., Ltd., Dongguan (CN)

(72) Inventors: Sheng Ding, Dongguan (CN); Li Qin Ye, Dongguan (CN); Chen Yuan Cheng, Keelung (TW); To Yung, Kwun Tong Kowloon (HK); Yu-Hung Hsiao, Taipei (TW)

(73) Assignee: DONGGUAN KEBEN ELECTRICAL APPLIANCE CO., LTD., Dongguan (CN)

( * ) Notice: Subject to any disclaimer, the term of this patent is extended or adjusted under 35 U.S.C. 154(b) by 0 days.

(21) Appl. No.: 17/147,103

(22) Filed: Jan. 12, 2021

(51) Int. Cl.
*H01R 13/40* (2006.01)
*H01R 13/44* (2006.01)
*H01R 24/20* (2011.01)

(52) U.S. Cl.
CPC ..... *H01R 13/44* (2013.01); *H01R 13/40* (2013.01); *H01R 24/20* (2013.01)

(58) Field of Classification Search
CPC ..... H01R 13/44; H01R 13/40; H01R 24/20
USPC ..... 439/131
See application file for complete search history.

(56) References Cited

U.S. PATENT DOCUMENTS 5,320,545 A * 6/1994 Brothers ..... H01R 13/7036 200/51.09
5,865,635 A * 2/1999 Hsiang ..... H01R 13/7036 439/188
6,111,210 A * 8/2000 Allison ..... H01R 13/7036 200/51.09
6,455,789 B1 * 9/2002 Allison ..... H01R 13/7036 200/51.09
7,070,432 B1 * 7/2006 Lin ..... H01R 13/7032 200/51.09
7,510,412 B1 * 3/2009 Valentin ..... H01R 13/4534 439/137
7,637,756 B1 * 12/2009 Hsu ..... H01R 13/4534 439/137
7,820,909 B2 * 10/2010 Castaldo ..... H01R 13/4534 174/53
7,931,482 B2 * 4/2011 Liao ..... H01R 13/44 439/137

(Continued)

FOREIGN PATENT DOCUMENTS

CN 204834996 U 12/2015

*Primary Examiner* — Harshad C Patel
(74) *Attorney, Agent, or Firm* — Muncy, Geissler, Olds & Lowe, PC

(57) ABSTRACT

Provided is a safety socket, including a first conductive seat, a second conductive seat, a first terminal, a first insulator, a second terminal, a second insulator, a first conductive sheet and a second conductive sheet. The first conductive seat includes a first elastic body. The first elastic body includes a first elastic connecting portion and two first elastic pieces. Both ends of the first elastic connecting portion are respectively integrally formed with the bottom ends of the first elastic pieces. The second conductive seat includes a second elastic body and a second socket terminal. The second elastic body includes a second elastic connecting portion and two second elastic pieces. Both ends of the second elastic connecting portion are respectively integrally formed with the bottom ends of the first elastic pieces. The elastic body can be reset by its own elastic force without a spring.

9 Claims, 11 Drawing Sheets

(56) References Cited

U.S. PATENT DOCUMENTS

| | | | | |
|---|---|---|---|---|
| 9,059,529 | B1 * | 6/2015 | Lai | H01R 13/44 |
| 9,647,375 | B2 * | 5/2017 | Lee | H01R 13/4534 |
| 10,096,929 | B2 | 10/2018 | Lee | |
| 10,243,296 | B2 * | 3/2019 | Cheng | H01R 13/18 |
| 10,985,490 | B1 * | 4/2021 | Ding | H01R 13/443 |
| 2003/0017731 | A1 * | 1/2003 | Huang | H01R 13/4534 439/137 |
| 2017/0279214 | A1 * | 9/2017 | Lee | H01R 13/4534 |
| 2018/0198229 | A1 * | 7/2018 | Cheng | H01R 13/703 |

* cited by examiner

SAFETY SOCKET TO PREVENT ELECTRIC SHOCK

BACKGROUND OF THE INVENTION

1. Field of the Invention

The present invention relates generally to a socket, and more particularly, to a safety socket to prevent an electric shock.

2. The Prior Arts

General sockets do not provide safety design. The insertion of conductive objects, such as metal rods, iron wires, nails, tweezers, fingers, etc., into the socket will cause electric shock.

There are conventional safety sockets on the market to solve the above problems, such as U.S. Pat. No. 7,931,482 B2, U.S. patent Ser. No. 10/096,929 B2, and Chinese Patent No. CN 204834996 U. However, these conventional safety sockets face at least the following problems:

First, the spring is easily broken by the plug blade, which causes the rotating part unable to reset, and the service life is short.

Second, the conductive seat includes a clamp base, two rotating parts, and a spring. The clamp base includes a base and three clamp arms. The hook of the rotating part passes through the perforation of the base, hooks the base, and is accommodated in the mounting seat, wherein the structure is very complicated, processing and assembly are not easy, and the manufacturing cost is high.

Third, the terminal is a sheet-like structure and has no elastic deformation ability, so that the insert cannot be easily inserted into the conductive seat. The user's hand must use extra force to insert the plug blade into the conductive seat, which is inconvenient.

Fourth, the insulating sheet and the inner shell are integrally formed, which is easy to break, and the broken insulating sheet will move to other places and become useless.

Fifth, the minimum distance between the two clamp arms is only 7.3 mm, which makes it impossible for a wider blade to be inserted into the slot between the two clamp arms.

SUMMARY OF THE INVENTION

A primary objective of the present invention is to provide a safety socket to prevent an electric shock, wherein the elastic body of the safety socket can be reset by its own elastic force without a spring, will not be broken by the blade and has a long service life.

Another objective of the present invention is to provide a safety socket to prevent an electric shock, wherein the conductive seat of the safety socket has a simple overall structure, is easy to process and assemble, and reduces manufacturing costs.

Yet another objective of the present invention is to provide a safety socket to prevent an electric shock, wherein the terminal has elastic deformation capability and can offset the thrust, the blade is easy to insert into the conductive seat, and the blade can be inserted into the conductive seat with a little force smoothly.

Another objective of the present invention is to provide a safety socket to prevent an electric shock, wherein the size of the socket is suitable for the blade of the existing plug.

Another objective of the present invention is to provide a safety socket to prevent an electric shock, wherein the insulator of the safety socket is separated from the inner shell without breaking, and can be fixed without moving to other places to maintain the functionality of insulation.

To achieve the foregoing objectives, the present invention provides a safety socket to prevent an electric shock, including a first conductive seat, a second conductive seat, a first terminal, a first insulator, a second terminal, a second insulator, a first conductive sheet and a second conductive sheet.

The first conductive seat includes a first elastic body and a first socket terminal. The first elastic body includes a first elastic connecting portion and two first elastic pieces. The two ends of the first elastic connecting portion and the bottom ends of first elastic pieces are integrally formed respectively. An outer side of each first elastic piece is provided with a contact. The first socket terminal includes a first socket connecting portion and two first clips, and the first socket connecting portion connects the bottom ends of the first clips. The first socket connecting portion is located above the first elastic connecting portion, and the first elastic pieces and the first clips together form a first socket.

The second conductive seat includes a second elastic body and a second socket terminal. The second elastic body includes a second elastic connecting portion and two second elastic pieces. The two ends of the second elastic connecting portion and the bottom ends of second elastic pieces are integrally formed respectively. An outer side of each second elastic piece is provided with a contact. The second socket terminal includes a second socket connecting portion and two second clips, and the second socket connecting portion connects the bottom ends of the second clips. The second socket connecting portion is located above the second elastic connecting portion, and the second elastic pieces and the second clips together form a second socket.

The first terminal has a contact and is used for connecting a wire.

The first insulator is disposed between one of the second elastic pieces and the first terminal.

The second terminal has a contact and is used for connecting a wire.

The second insulator is disposed between one of the first elastic pieces and the second terminal.

The first conductive sheet includes a first end and a second end. The first end of the first conductive sheet is located between the first terminal and the first insulator and a protruding contact is disposed on a side facing the first terminal. The second end of the first conductive sheet is located on one side of the other of the first elastic sheets, and a protruding contact is disposed on a side facing the other of the first elastic sheets.

The second conductive sheet includes a first end and a second end, and does not contact the first conductive sheet. The first end of the second conductive sheet is located between the second terminal and the second insulator, and a protruding contact is disposed on a side facing the second terminal. The second end of the second conductive sheet is located on a side of the other of the second elastic pieces, and a protruding contact is disposed on a side facing the other second elastic sheets.

In a preferred embodiment, the safety socket to prevent an electric shock further includes an inner shell; the first conductive seat, the second conductive seat, the first terminal, the first insulator, the second terminal, the second insulator, the first conductive sheet, and the second conductive sheet are all disposed inside the inner shell.

Preferably, the first terminal is U-shaped, clamped on a first piece of the inner shell, and comprises a contact portion and a wiring portion, the contact portion of the first terminal is close to the first end of the first conductive sheet, with the top higher than the top of the first piece, and is provided with a contact; the wiring portion of the first terminal is used to connect a wire; and the second terminal is U-shaped, clamped on a second piece of the inner shell, and comprises a contact portion and a wiring portion, the contact portion of the second terminal is close to the first end of the second conductive sheet, with the top higher than the top of the second piece, and is provided with a contact; the wiring portion of the second terminal is used to connect another wire.

Preferably, the inner shell is recessed with a first positioning groove, a second positioning groove, a first positioning post and a second positioning post, and one side of one of the first clips is convexly provided with a first positioning portion, the first positioning portion is provided with a first perforation, one side of one of the second clips convexly provided with a second positioning portion, the second positioning portion is provided with a second perforation, the first positioning portion is located in the first positioning groove, the first positioning post penetrates through the first perforation, the second positioning portion is located in the second positioning groove, and the second positioning post penetrates through the second perforation.

Preferably, the inner shell comprises a first positioning block and a second positioning block, one side of the first elastic connecting portion is provided with a notch, the first socket terminal is provided with a groove, and the groove of the first socket terminal extends from one of the first clips through the first socket connecting portion to the other of the first clips; one side of the second elastic connecting portion is provided with a notch, and the second socket terminal is provided with a groove, the groove of the second socket terminal extends from one of the second clips through the second socket connecting portion to the other of the second clips; the first positioning block is located in notch of the first elastic connecting portion and the groove of the first socket terminal, and located under the other of the first clips, the second positioning block is located in the notch of the second elastic connecting portion and the groove of the second socket terminal, and located under the other of the second clips.

In a preferred embodiment, each first elastic piece has an outer wall and an inner wall, an outer side of the outer wall of each first elastic piece is provided with a contact, and the top end of the inner wall of each first elastic piece and the top end of the outer wall of the first elastic piece are integrally formed, the inner wall of each first elastic piece is bent downward into a zigzag shape, and both ends of the first elastic connecting portion and the bottom ends of the outer walls of the first elastic pieces are respectively integrally formed; and wherein, each second elastic piece has an outer wall and an inner wall, an outer side of the outer wall of each second elastic piece is provided with a contact, and the top end of the inner wall of each second elastic piece and the top end of the outer wall of the second elastic piece are integrally formed, the inner wall of each second elastic piece is bent downward into a zigzag shape, and both ends of the second elastic connecting portion and the bottom ends of the outer walls of the second elastic pieces are respectively integrally formed.

Preferably, a minimum distance between the inner walls of the first elastic pieces is 8.5 to 9.5 mm, and a minimum distance between the inner walls of the second elastic pieces is 8.5 to 9.5 mm.

Preferably, the minimum distance between the inner walls of the first elastic pieces is 9 mm, and the minimum distance between the inner walls of the second elastic pieces is 9 mm.

In a preferred embodiment, the first insulator is detachably disposed between one of the second elastic pieces and the first terminal, and one of the second elastic pieces and the first end of the first conductive sheet clamp on the first insulator; the second insulator is detachably disposed between one of the first elastic pieces and the second terminal, and one of the first elastic pieces and the first end of the second conductive sheet clamp on the second insulator.

The effect of the present invention is that the first elastic pieces and the second elastic pieces can be reset by their own elastic force and no spring is needed, so that the first and second elastic pieces will not be broken by the first and second blades of a plug, and the service life is longer.

Furthermore, neither the first socket terminal nor the second socket terminal needs to be provided with any perforations to provide the first elastic pieces and the second elastic pieces for pivotal use. Therefore, the overall structure of the first conductive seat and the second conductive seat is simple, easy to process and assemble, and has low manufacturing cost.

In addition, the contact portion of the first terminal is slightly bent and deformed to offset the thrust of the first end of the first conductive sheet, so that the second blade is easily inserted into the second conductive seat, and the contact portion of the second terminal is slightly bent and deformed to offset the thrust of the first end of the second conductive sheet, so that the first blade is easily inserted into the first conductive seat. Therefore, the user's hand can insert the second blade into the second conductive seat and the first blade into the first conductive seat with only a little force, which is very convenient.

Furthermore, the size of the first socket and the size of the second socket are suitable for the size of the first blade and the size of the second blade of the existing plug.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 1:
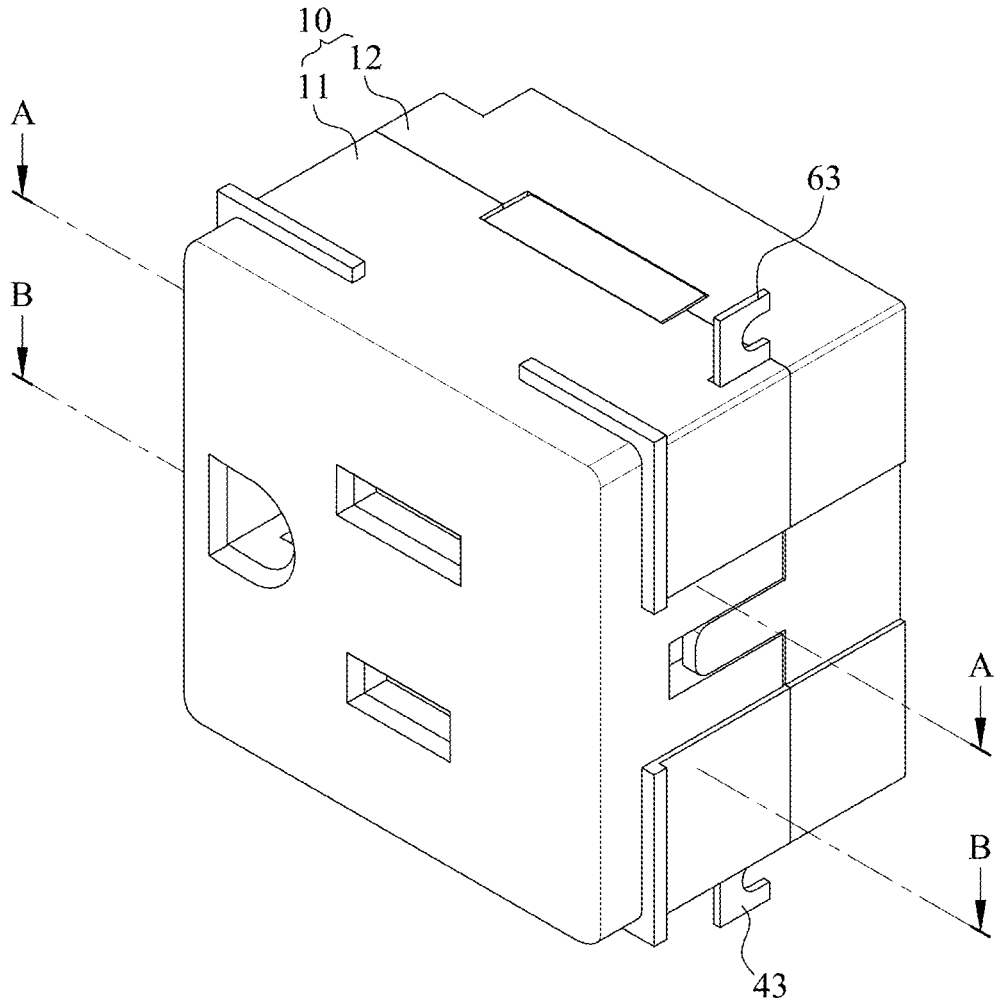
FIG. 1 is a schematic view of the safety socket of the present invention.

The accompanying drawings are included to provide a further understanding of the invention, and are incorporated in and constitute a part of this specification. The drawings illustrate embodiments of the invention and, together with the description, serve to explain the principles of the invention.

As shown in FIGS. 1-6, the present invention provides a safety socket to prevent an electric shock, including a housing 10, a first conductive seat 20, a second conductive seat 30, a first terminal 40, a first insulator 50, a second terminal 60, a second insulator 70, a first conductive sheet 80 and a second conductive sheet 90. The housing 10 includes a first outer shell 11, a second outer shell 12, and an inner shell 13. The first outer shell 11 is detachably combined with the second outer shell 12, and the inner shell 13 is disposed inside the first outer shell 11 and the second outer shell 12. The first conductive seat 20, the second conductive seat 30, the first terminal 40, the first insulator 50, the second terminal 60, the second insulator 70, the first conductive sheet 80 and the second conductive sheet 90 are all arranged in the inner shell 13.

Figure 7:
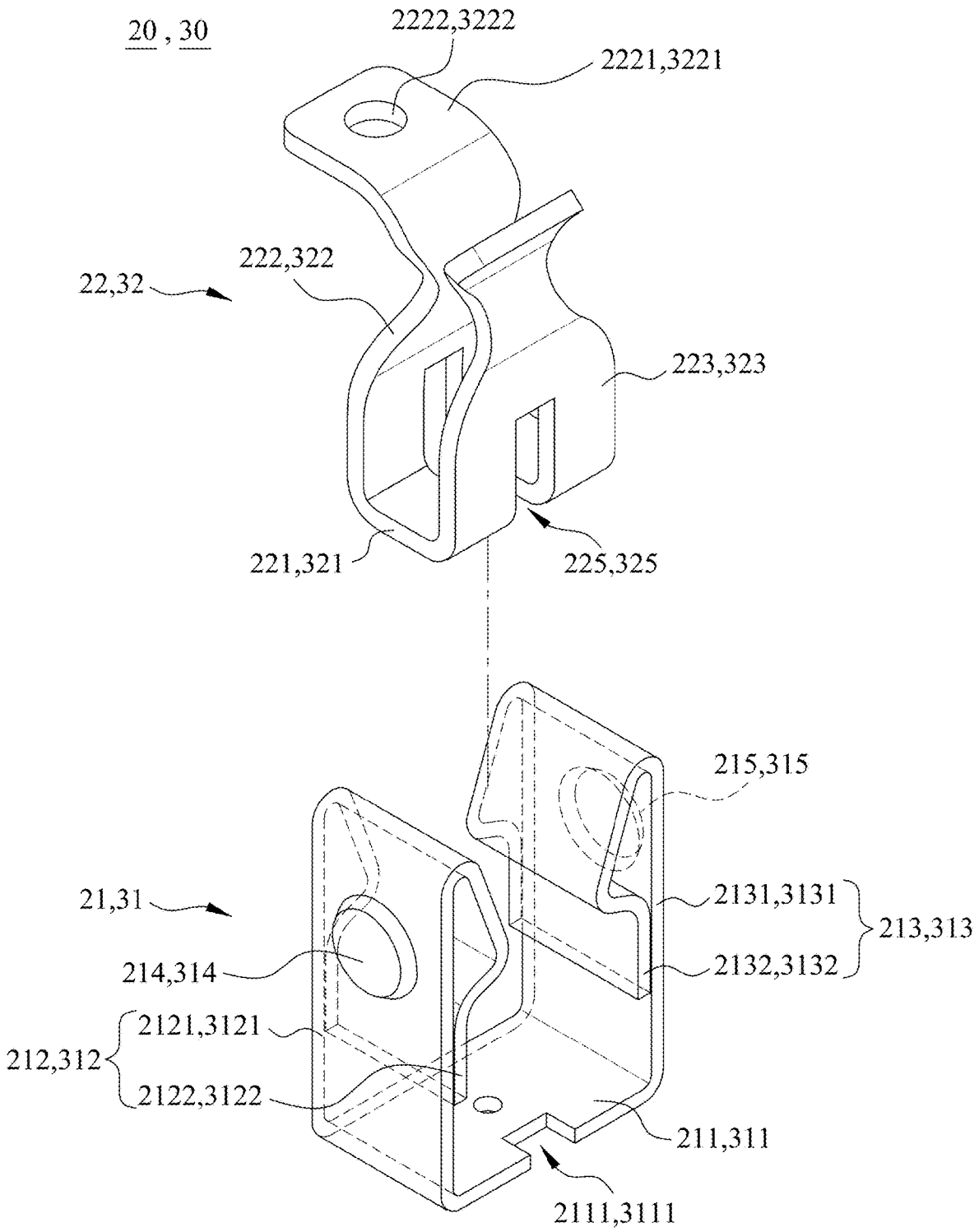
FIG. 7 is an exploded view of the first conductive seat and the second conductive seat of the present invention.

As shown in FIG. 7, the first conductive seat 20 includes a first elastic body 21 and a first socket terminal 22. The first elastic body 21 includes a first elastic connecting portion 211 and two first elastic pieces 212, 213. Each first elastic piece 212, 213 has an outer wall 2121, 2131 and an inner wall 2122, 2132. An outer side of the outer wall 2121 is provided with a contact 214, an outer side of the outer wall 2131 is provided with a contact 215, the tops of the inner walls 2122, 2132 and the tops of the outer walls 2121, 2131 are integrally formed, respectively, and the inner walls 2122, 2132 are bent downward into a zigzag shape, and both ends of the first elastic connecting portion 211 are integrally formed with the bottom ends of the outer walls 2121 and 2131, respectively. The first socket terminal 22 includes a first socket connecting portion 221 and two first clips 222 and 223, and the first socket connecting portion 221 is connected to the bottom ends of the first clips 222 and 223. The first socket connecting portion 221 is located above the first elastic connecting portion 211. The first elastic pieces 212, 213 and the first clip pieces 222, 223 together form a first socket 224. As shown in FIG. 7, the second conductive seat 30 includes a second elastic body 31 and a second socket terminal 32. The second elastic body 31 includes a second elastic connecting portion 311 and two second elastic pieces 312, 313. Each of the second elastic pieces 312, 313 has an outer wall 3121, 3131 and an inner wall 3122, 3132. An outer side of the outer wall 3121 is provided with a contact 314, an outer side of the outer wall 3131 is provided with a contact 315, the tops of the inner walls 3122, 3132 and the tops of the outer walls 3121, 3131 are integrally formed, respectively, the inner walls 3122, 3132 are bent downward into a zigzag shape, and both ends of the second elastic connecting portion 311 are integrally formed with the bottom ends of the outer walls 3121 and 3131, respectively. The second socket terminal 32 includes a second socket connecting portion 321 and two second clips 322 and 323, and the second socket connecting portion 321 is connected to the bottom ends of the second clips 322 and 323. The second socket connecting portion 321 is located above the second elastic connecting portion 311. The second elastic pieces 312, 313 and the second clip pieces 322, 323 together form a second socket 324.

Figure 3:
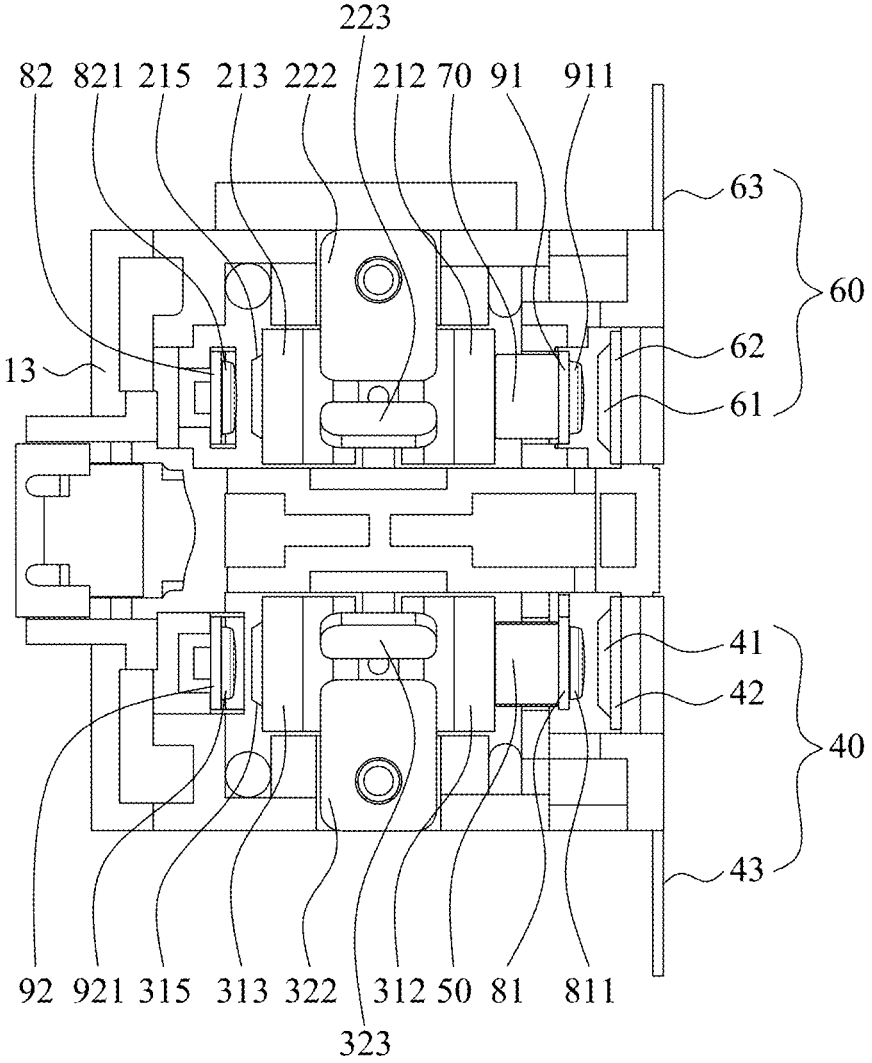
FIG. 3 is a top view of the inner shell and internal components of the present invention.
Figure 8:
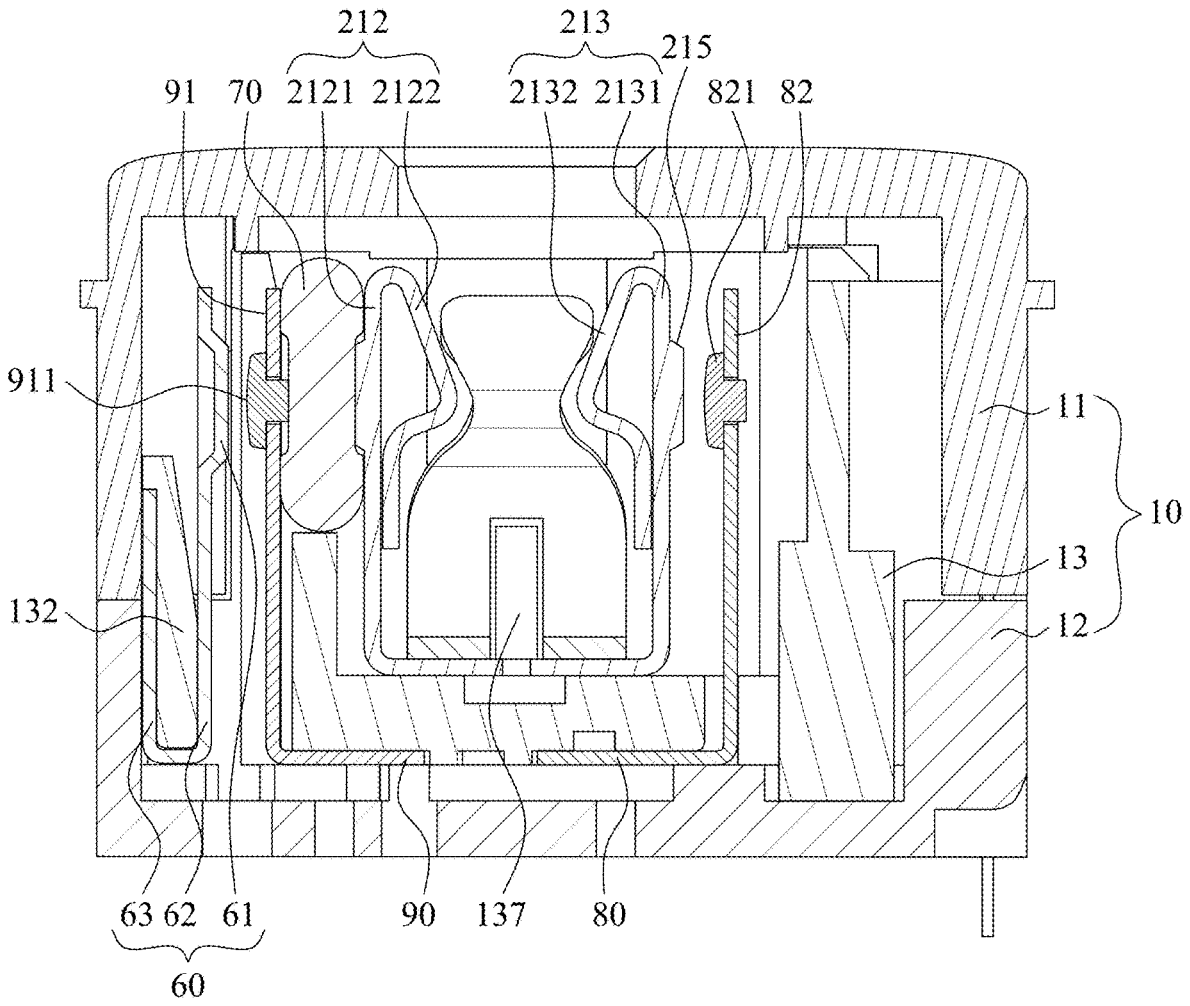
FIG. 8 is a cross-sectional view along the line A-A in FIG. 1.
Figure 9:
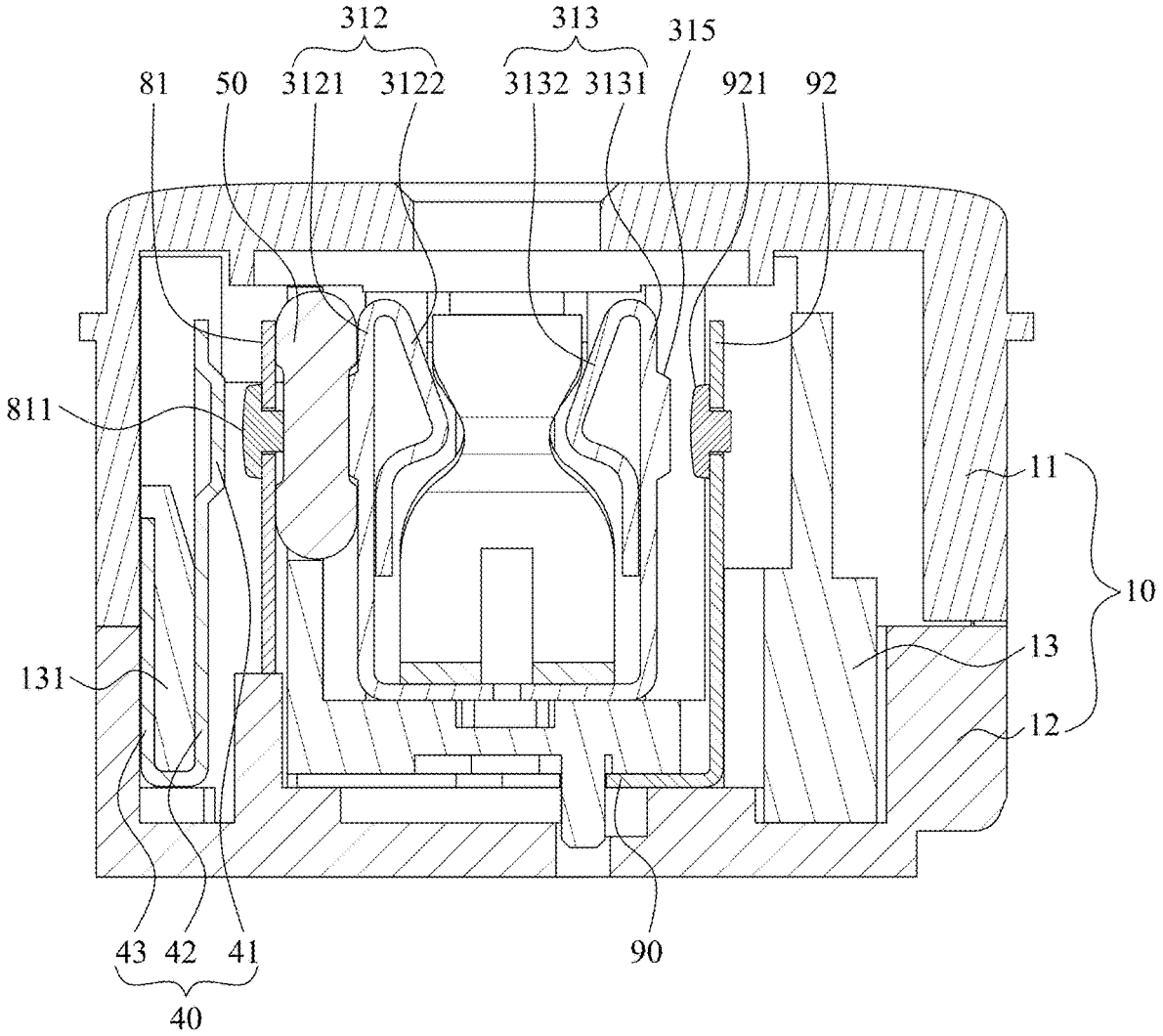
FIG. 9 is a cross-sectional view along the line B-B in FIG. 1.

As shown in FIG. 3 and FIG. 9, the first terminal 40 has a contact 41 and is used for connecting a wire (not shown), and the first insulator 50 is disposed between the second elastic piece 312 and the first terminal 40. As shown in FIG. 3 and FIG. 8, the second terminal 60 has a contact 61 and is used for connecting another wire (not shown), and the second insulator 70 is disposed between the first elastic piece 212 and the second terminal 60.

Figure 5:
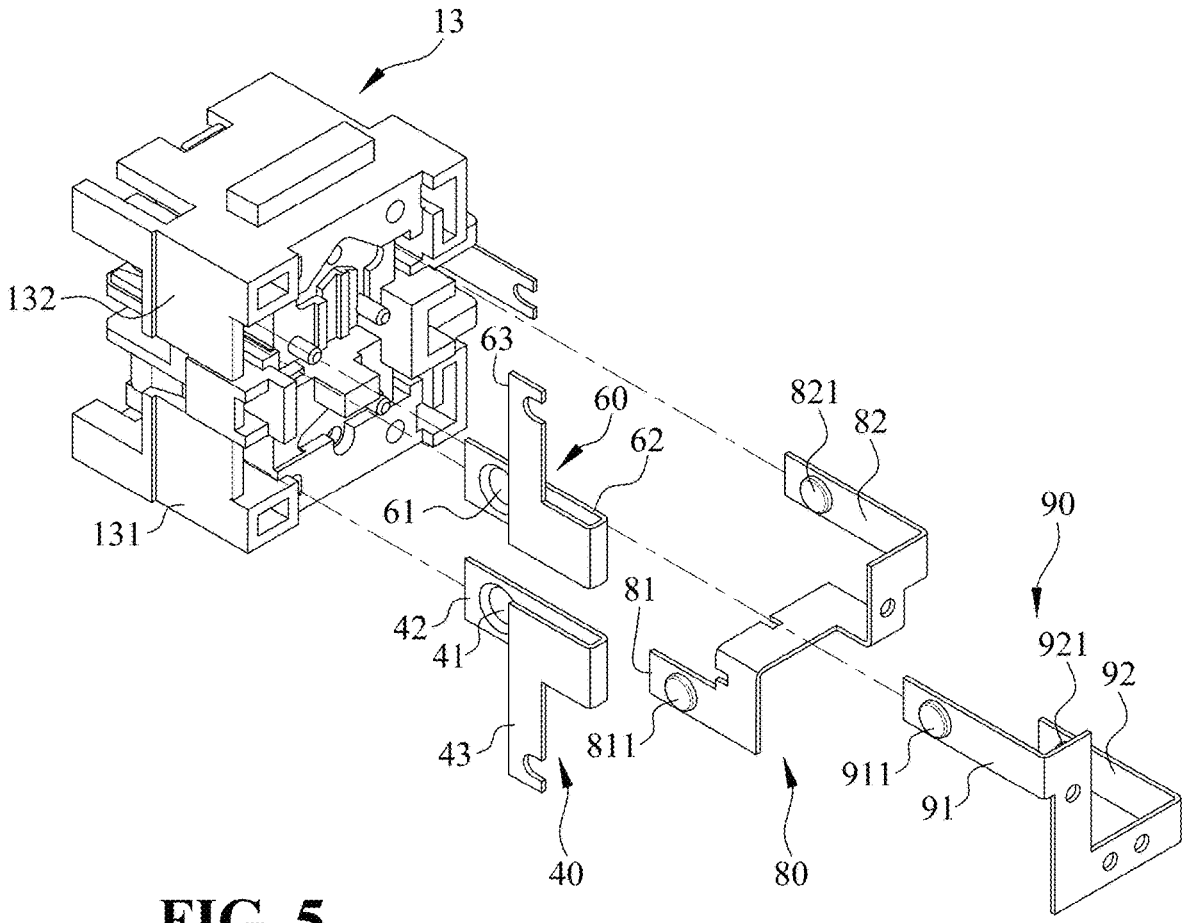
FIG. 5 is an exploded view of the inner shell, the first terminal and the second terminal of the present invention.

As shown in FIG. 5, the first conductive sheet 80 includes a first end 81 and a second end 82, and the second conductive sheet 90 includes a first end 91 and a second end 92, and does not contact the first conductive sheet 80. As shown in FIG. 3 and FIG. 9, the first end 81 is located between the first terminal 40 and the first insulator 50, and a contact 811 is protruding from the side of the first end 81 facing the first terminal 40; the second end 92 is located on one side of the second elastic piece 313, and a contact 921 is protruded from the side of the second end 92 facing the second elastic piece 313. As shown in FIG. 3 and FIG. 8, the second end 82 is located on one side of the first elastic piece 213, and a contact 821 is protruding from the side of the second end 82 facing the first elastic piece 213; the first end 91 is located between the second terminal 60 and the second insulator 70, and a contact 911 is protruding from the side of the first end 91 facing the second terminal 60.

Figure 10:
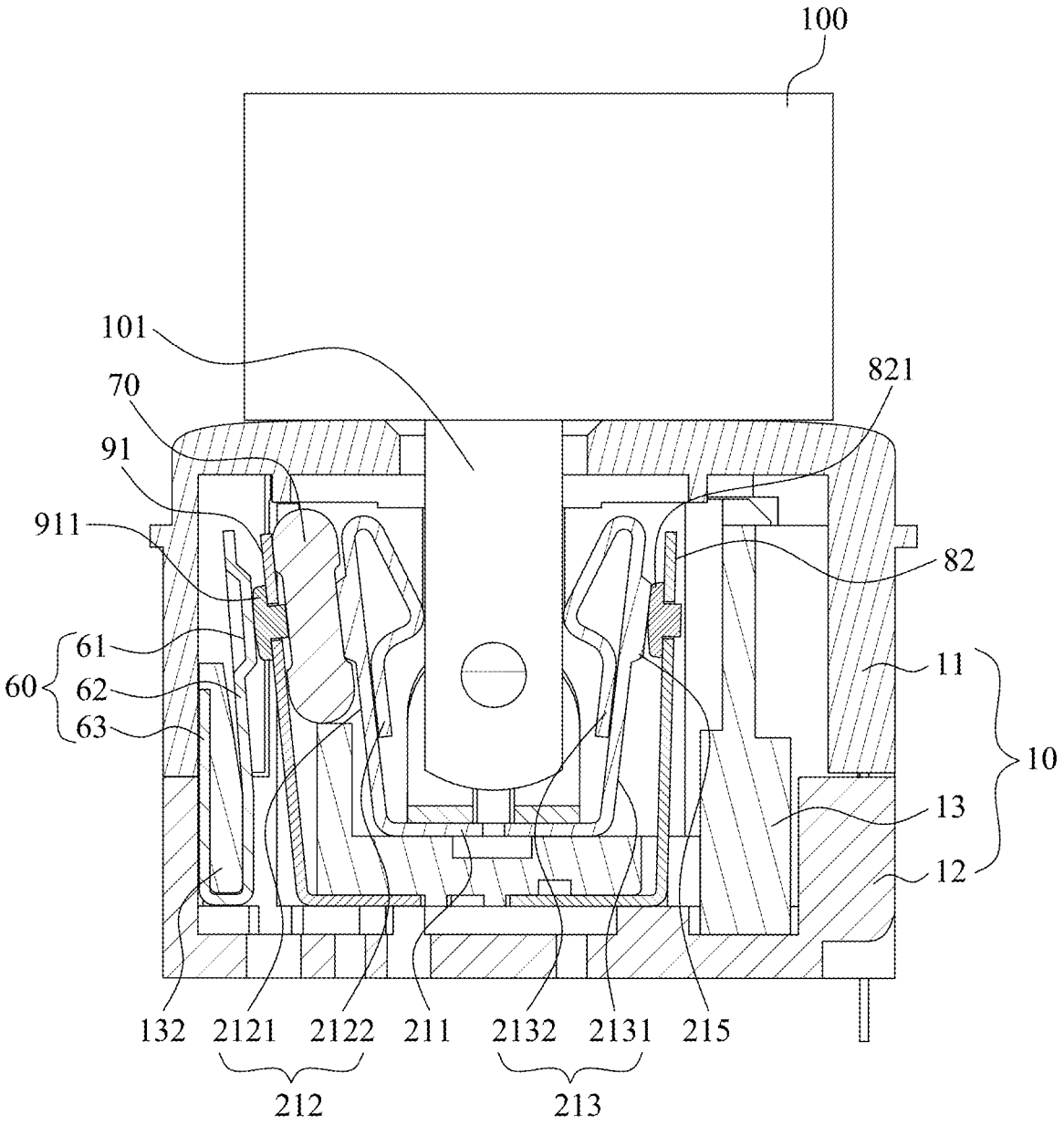
FIG. 10 is a cross-sectional view of the first blade of the plug inserted into the first conductive seat of the present invention.
Figure 11:
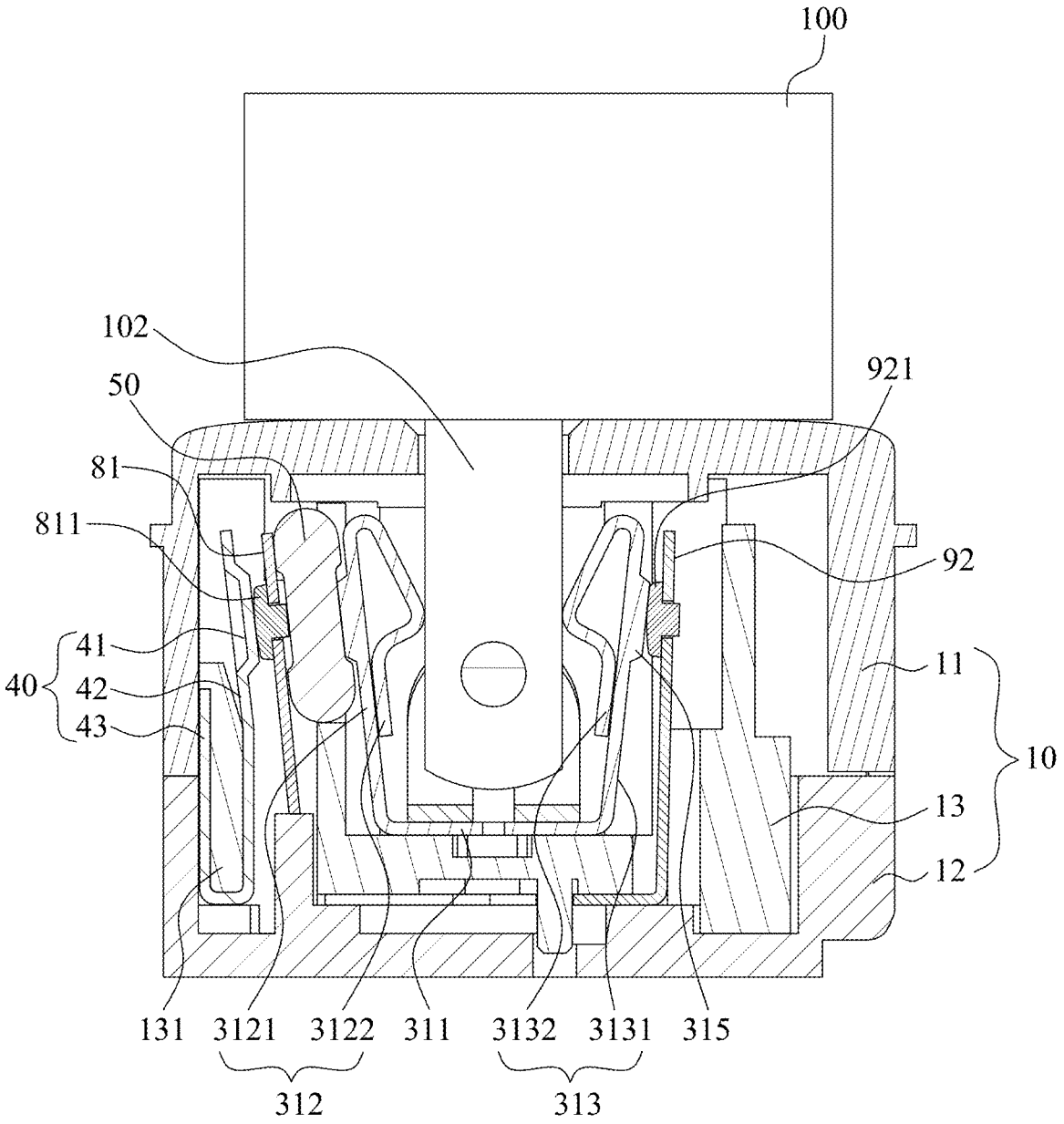
FIG. 11 is a cross-sectional view of the second blade of the plug inserted into the second conductive seat of the present invention.

As shown in FIG. 10, after a first blade 101 of a plug 100 passes through the first outer shell 11 and is inserted into the first socket 224, the first clips 222, 223 clamp on the first blade 101. The first blade 101 squeezes the inner walls 2122, 2132, and the inner walls 2122, 2132 push the outer walls 2121, 2131 to pivot outward relative to the first elastic connecting portion 211. The outer wall 2121 pushes the second insulator 70, the second insulator 70 further pushes the first end 91, the contact 911 contacts the contact 61, and the contact 215 contacts the contact 821. As shown in FIG. 11, after a second blade 102 of the plug 100 passes through the first outer shell 11 and is inserted into the second socket 324, the second clips 322, 323 clamp on the second blade 102. The second blade 102 squeezes the inner walls 3122, 3132, and the inner walls 3122, 3132 push the outer walls 3121, 3131 to pivot outward relative to the second elastic connecting portion 311. The outer wall 3121 pushes the first insulator 50, the first insulator 50 further pushes the first end 81, the contact 811 contacts the contact 41, and the contact 315 contacts the contact 921. Thereby, the first blade 101, the first conductive seat 20, the first conductive sheet 80 and the first terminal 40 are in a conductive state, and the second blade 102, the second conductive seat 30, the second conductive sheet 90 and the second terminal 60 are in a conductive state.

As shown in FIG. 8, after the first blade 101 is withdrawn from the first socket 224, the first elastic pieces 212, 213 are pivoted inwardly to return to the initial position through their own elastic force. The first end 91 returns to the initial position through its own elastic force and pushes the second insulator 70 to return to the initial position, the contact 911 is away from the contact 61, and the contact 215 is away from the contact 821. As shown in FIG. 9, after the second blade 102 is withdrawn from the second socket 324, the second elastic pieces 312 and 313 are pivoted inwardly to return to the initial position through their own elastic force. The first end 81 returns to the initial position by its elastic force and pushes the first insulator 50 to return to the initial position, the contact 811 is away from the contact 41, and the contact 315 is away from the contact 921. Thereby, the first conductive seat 20, the first conductive sheet 80 and the first terminal 40 are in a disconnected state, and the second conductive seat 30, the second conductive sheet 90 and the second terminal 60 are in a disconnected state.

When a person without common sense of electricity, such as a child, inserts conductive objects such as metal rods, iron wires, nails, tweezers, fingers, etc. into the first socket 224 and the second socket 324, because the size of the conductive object is the same as the size of the first socket 224 and the size of the second socket 324, the conductive object is unable to push apart the first elastic pieces 212, 213 and the second elastic pieces 312, 313. As long as the first elastic pieces 212, 213 and the second elastic pieces 312, 313 cannot be pushed apart, the contact 911 will not contact the contact 61, the contact 215 will not contact the contact 821, the contact 811 will not contact the contact 41, and the contact 315 will not contact the contact 921. Therefore, the first conductive seat 20, the first conductive sheet 80 and the first terminal 40 are kept in the disconnected state, and the second conductive seat 30, the second conductive sheet 90 and the second terminal 60 are kept in the disconnected state, which effectively prevents electric shock caused when a conductive object is inserted, and the safety is ensured.

Furthermore, the first elastic pieces 212, 213 and the second elastic pieces 312, 313 can be reset through their own elastic force and no spring is needed, so that the first and second elastic pieces will not be inserted by the first blade 101 and the second blade 102, and the service life is longer.

In addition, the first socket terminal 22 and the second socket terminal 32 do not need any perforations to provide the first elastic pieces 212, 213 and the second elastic pieces 312, 313 for pivotal use. Therefore, the overall structure of the first conductive seat 20 and the second conductive seat 30 is simple, easy to process and assemble, and has low manufacturing cost.

As shown in FIGS. 2, 3, 5 and 9, in a preferred embodiment, the first terminal 40 is U-shaped and is clamped on a first piece 131 of the inner shell 13, and includes a contact portion 42 and a wiring portion 43. The contact portion 42 is close to the first end 81, with the top end higher than the top end of the first piece 131, and is provided with a contact 41. As shown in FIG. 1, the wiring portion 43 passes through one side of the first outer shell 11 and is used for connecting electric wires. Based on the above structural configuration, the contact portion 42 has the ability to elastically deform. As shown in FIGS. 2, 3, 5 and 8, in a preferred embodiment, the second terminal 60 is U-shaped and is clamped on a second piece 132 of the inner shell 13, and includes a contact portion 62 and a wiring portion 63. The contact portion 62 is close to the first end 91, with the top end higher than the top end of the second piece 132, and is provided with a contact 61. As shown in FIG. 1, the wiring portion 63 passes through the other side of the first outer shell 11 and is used for connecting another electric wire. Based on the above structural configuration, the contact portion 62 has the ability to elastically deform.

As shown in FIG. 11, the contact portion 42 is slightly bent and deformed to offset the thrust of the first end 81, so that the second blade 102 is easily inserted into the second conductive seat 30. As shown in FIG. 10, the contact portion 62 is slightly bent and deformed to offset the thrust of the first end portion 91, so that the first blade 101 is easily inserted into the first conductive seat 20. Therefore, the user's hand can insert the second blade 102 into the second conductive base 30 and the first blade 101 into the first conductive base 20 with only a little force.

Figure 2:
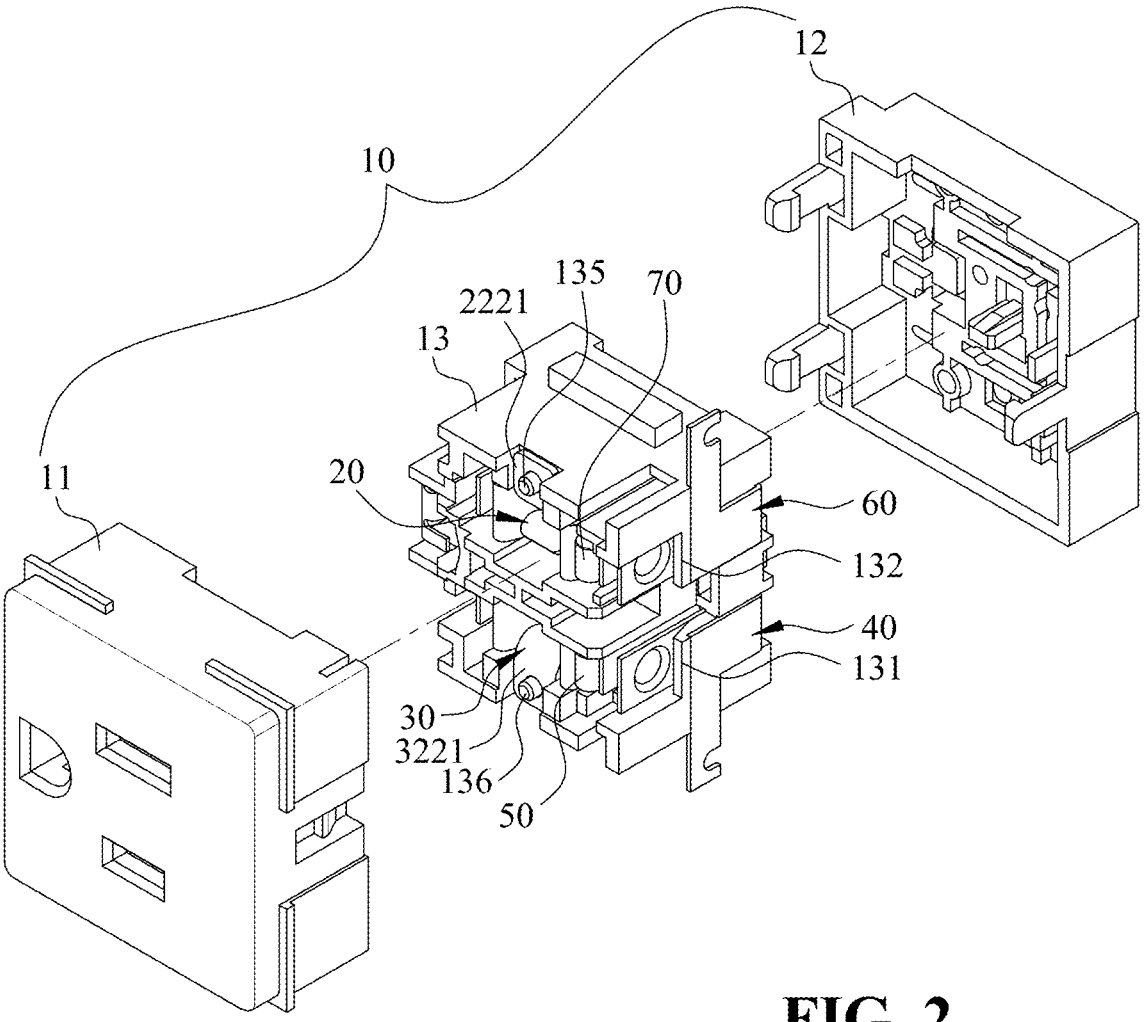
FIG. 2 is an exploded view of the housing of the present invention.
Figure 4:
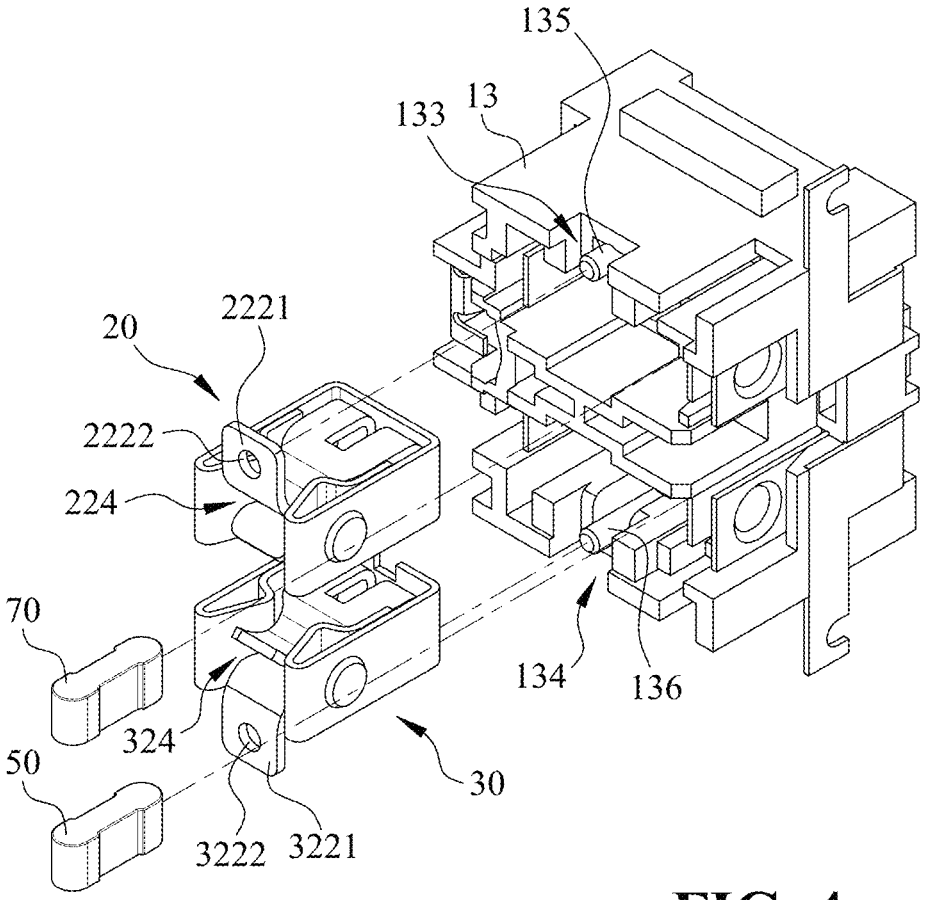
FIG. 4 is an exploded view of the inner shell, the first conductive seat, the second conductive seat, the first insulator and the second insulator of the present invention.
Figure 6:
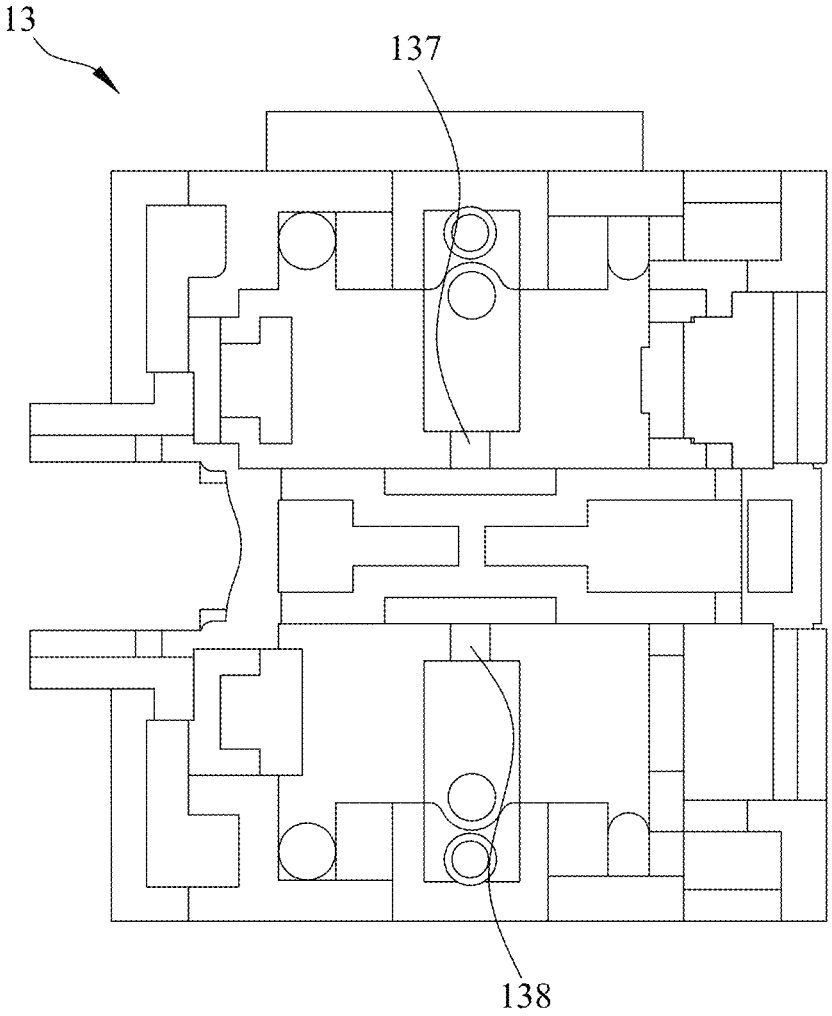
FIG. 6 is a top view of the inner shell of the present invention.

As shown in FIG. 4, in a preferred embodiment, the inner shell 13 is recessed with a first positioning groove 133, a second positioning groove 134, a first positioning post 135, and a second positioning post 136. As shown in FIG. 7, one side of the first clip 222 is protruding with a first positioning portion 2221, the first positioning portion 2221 is provided with a first perforation 2222, and one side of the second clip 322 is protruding with a second positioning portion 3221, and the second positioning portion 3221 provided with a second perforation 3222. As shown in FIG. 2 and FIG. 3, the first positioning portion 2221 is located in the first positioning groove 133, the second positioning portion 3221 is located in the second positioning groove 134, the first positioning post 135 penetrates through the first perforation 2222, and the positioning post 136 penetrates through the second perforation 3222. As shown in FIG. 6, the inner shell 13 has a first positioning block 137 and a second positioning block 138. As shown in FIG. 7, a notch 2111 is formed on one side of the first elastic connecting portion 211, and a groove 225 is formed on the first socket terminal 22. The groove 225 extends from the first clip 222 through the first socket connecting portion 221 to one side of the first clip 223. The second elastic connecting portion 311 is provided with a notch 3111, and the second socket terminal 32 is provided with a groove 325. The groove 325 extends from the second clip 322 through the second socket connecting portion 321 to the second clip 323. As shown in FIG. 8, the first positioning block 137 is located in the recess 2111 and the groove 225, and is located below the first clip 223. The second positioning block 138 is located in the recess 3111 and the groove 325, and is located below the second clip 323. Thereby, after the first socket terminal 22 and the second socket terminal 32 are installed in the inner shell 13, the first and second socket terminals can be quickly positioned without the problem of reverse installation, and the first socket terminal 22 and the second socket terminal 32 are prevented from moving freely.

In a preferred embodiment, a minimum distance between the inner walls 2122, 2132 is 8.5 to 9.5 mm, and a minimum distance between the inner walls 3122, 3132 is 8.5 to 9.5 mm. Preferably, the spacing is 9 mm. Thereby, the size of the first socket 224 and the size of the second socket 324 are suitable for the size of the first blade 101 and the size of the second blade 102 of the existing plug 100.

As shown in FIGS. 3, 4, and 9, in a preferred embodiment, the first insulator 50 is detachably disposed between the outer wall 3121 and the contact portion 42, and the outer wall 3121 and the first end 81 clamp on the first insulator 50. As shown in FIGS. 3, 4 and 8, in a preferred embodiment, the second insulator 70 is detachably disposed between the outer wall 2121 and the contact portion 62, and the outer wall 2121 and the first end 91 clamp on the second insulator 70. Thereby, both the first insulator 50 and the second insulator 70 are separated from the inner shell 13 and are free from the problem of breaking, and can also be fixed without moving to other places and maintain the insulation functions.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A safety socket to prevent an electric shock, comprising:

a first conductive seat, further comprising a first elastic body and a first socket terminal; the first elastic body comprising a first elastic connecting portion and two first elastic pieces; the two ends of the first elastic connecting portion and the bottom ends of first elastic pieces being integrally formed respectively; an outer side of each first elastic piece being provided with a contact; the first socket terminal comprising a first socket connecting portion and two first clips, and the first socket connecting portion connecting the bottom ends of the first clips; the first socket connecting portion being located above the first elastic connecting portion, and the first elastic pieces and the first clips together forming a first socket;

a second conductive seat, further comprising a second elastic body and a second socket terminal; the second elastic body comprising a second elastic connecting portion and two second elastic pieces; the two ends of the second elastic connecting portion and the bottom ends of second elastic pieces being integrally formed respectively; an outer side of each second elastic piece being provided with a contact; the second socket terminal comprising a second socket connecting portion and two second clips, and the second socket connecting portion connecting the bottom ends of the second clips; the second socket connecting portion being located above the second elastic connecting portion, and the second elastic pieces and the second clips together forming a second socket;

a first terminal, having a contact and used for connecting a wire;

a first insulator, disposed between one of the second elastic pieces and the first terminal;

a second terminal, having a contact and used for connecting a wire;

a second insulator, disposed between one of the first elastic pieces and the second terminal;

a first conductive sheet, comprising a first end and a second end; the first end of the first conductive sheet being located between the first terminal and the first insulator, and a protruding contact being disposed on a side facing the first terminal; the second end of the first conductive sheet being located on one side of the other of the first elastic sheets, and a protruding contact being disposed on a side facing the other of the first elastic sheets; and a second conductive sheet, comprising a first end and a second end, and not contact the first conductive sheet; the first end of the second conductive sheet being located between the second terminal and the second insulator, and a protruding contact being disposed on a side facing the second terminal; the second end of the second conductive sheet being located on a side of the other of the second elastic pieces, and a protruding contact being disposed on a side facing the other second elastic sheets.

2. The safety socket according to claim 1, further comprising an inner shell; the first conductive seat, the second conductive seat, and the first terminal, the first insulator, the second terminal, the second insulator, the first conductive sheet, and the second conductive sheet being all disposed inside the inner shell.

3. The safety socket according to claim 2, wherein the first terminal is U-shaped, clamped on a first piece of the inner shell, and comprises a contact portion and a wiring portion, the contact portion of the first terminal is close to the first end of the first conductive sheet, with the top higher than the top of the first piece, and is provided with a contact; the wiring portion of the first terminal is used to connect a wire; and the second terminal is U-shaped, clamped on a second piece of the inner shell, and comprises a contact portion and a wiring portion, the contact portion of the second terminal is close to the first end of the second conductive sheet, with the top higher than the top of the second piece, and is provided with a contact; the wiring portion of the second terminal is used to connect another wire.

4. The safety socket according to claim 2, wherein the inner shell is recessed with a first positioning groove, a second positioning groove, a first positioning post and a second positioning post, and one side of one of the first clips is convexly provided with a first positioning portion, the first positioning portion is provided with a first perforation, one side of one of the second clips convexly provided with a second positioning portion, the second positioning portion is provided with a second perforation, the first positioning portion is located in the first positioning groove, the first positioning post penetrates through the first perforation, the second positioning portion is located in the second positioning groove, and the second positioning post penetrates through the second perforation.

5. The safety socket according to claim 2, wherein the inner shell comprises a first positioning block and a second positioning block, one side of the first elastic connecting portion is provided with a notch, the first socket terminal is provided with a groove, and the groove of the first socket terminal extends from one of the first clips through the first socket connecting portion to the other of the first clips; one side of the second elastic connecting portion is provided with a notch, and the second socket terminal is provided with a groove, the groove of the second socket terminal extends from one of the second clips through the second socket connecting portion to the other of the second clips; the first positioning block is located in notch of the first elastic connecting portion and the groove of the first socket terminal, and located under the other of the first clips, the second positioning block is located in the notch of the second elastic connecting portion and the groove of the second socket terminal, and located under the other of the second clips.

6. The safety socket according to claim 1, wherein each first elastic piece has an outer wall and an inner wall, an outer side of the outer wall of each first elastic piece is provided with a contact, and the top end of the inner wall of each first elastic piece and the top end of the outer wall of the first elastic piece are integrally formed, the inner wall of each first elastic piece is bent downward into a zigzag shape, and both ends of the first elastic connecting portion and the bottom ends of the outer walls of the first elastic pieces are respectively integrally formed; and wherein, each second elastic piece has an outer wall and an inner wall, an outer side of the outer wall of each second elastic piece is provided with a contact, and the top end of the inner wall of each second elastic piece and the top end of the outer wall of the second elastic piece are integrally formed, the inner wall of each second elastic piece is bent downward into a zigzag shape, and both ends of the second elastic connecting portion and the bottom ends of the outer walls of the second elastic pieces are respectively integrally formed.

7. The safety socket according to claim 6, wherein a minimum distance between the inner walls of the first elastic pieces is 8.5 to 9.5 mm, and a minimum distance between the inner walls of the second elastic pieces is 8.5 to 9.5 mm.

8. The safety socket according to claim 7, wherein the minimum distance between the inner walls of the first elastic pieces is 9 mm, and the minimum distance between the inner walls of the second elastic pieces is 9 mm.

9. The safety socket according to claim 1, wherein the first insulator is detachably disposed between one of the second elastic pieces and the first terminal, and one of the second elastic pieces and the first end of the first conductive sheet clamp on the first insulator; the second insulator is detachably disposed between one of the first elastic pieces and the second terminal, and one of the first elastic pieces and the first end of the second conductive sheet clamp on the second insulator.

* * * * *